US006064051A

United States Patent [19]

Gray

[11] Patent Number: 6,064,051

[45] Date of Patent: May 16, 2000

[54] MICROWAVABLE HAIR CURLER

[76] Inventor: Diane L. Gray, 227 Ridgely Dr., Verona, Pa. 15147

[21] Appl. No.: 09/099,645

[22] Filed: Jun. 18, 1998

[51] Int. Cl.[7] ..... H05B 6/64

[52] U.S. Cl. ..... 219/759; 132/220; 132/240; 132/264

[58] Field of Search ..... 219/759, 222, 219/226; 132/220, 227, 229, 233, 236, 241, 226, 240, 243, 264, 148

[56] References Cited

U.S. PATENT DOCUMENTS

| | | | |
|---|---|---|---|
| 2,260,213 | 10/1941 | Davis | 132/240 |
| 2,465,515 | 3/1949 | Chedister | 132/241 |
| 3,234,952 | 2/1966 | Endter et al. | 132/243 |
| 4,041,961 | 8/1977 | Shaler et al. | 132/40 |
| 4,164,951 | 8/1979 | Shaler et al. | 132/31 R |

*Primary Examiner*—Teresa Walberg
*Assistant Examiner*—Shawntina Fuqua
*Attorney, Agent, or Firm*—William L. Krayer

[57] ABSTRACT

A hair curler has a support and a sheath thereon containing a gel comprising a humectant, water, and a crosslinked water soluble polymer. The curler may be heated in a microwave oven; it emits moist heat during use and reabsorbs moisture from the atmosphere between uses.

11 Claims, 4 Drawing Sheets

MICROWAVABLE HAIR CURLER

TECHNICAL FIELD

This invention relates to hair curlers which may be heated in a microwave oven prior to use on the hair. The curlers are built to include a heat-retaining gel on a supporting surface of themoset plastic or other heat-resistant material. The curlers can be heated repeatedly without significant loss of moisture although they provide a moist heat to the hair. The gel re-absorbs moisture from the air between uses. During use, the curler is separated from the user's head by a separable base which can be temporarily fastened to the curler.

BACKGROUND OF THE INVENTION

It is desirable to retain heat in hair curlers, and as the microwave oven has become more common in ordinary households, workers in the art have designed curlers to utilize their ready availability. For example, Henderson, in U.S. Pat. No. 4,538,630, fills a substantially cylindrical curler with a lossy dielectric material, such as a ferrite or zirconium dioxide. Graves, in U.S. Pat. No. 5,676,871, also proposes use of a lossy dielectric material in one variation of her invention. Switlicki, in U.S. Pat. No. 4,710,609, fills the curler cavity with a wicking material and water, leaving a vent for expanding water to escape if the temperature becomes too high in the microwave. In U.S Pat. No. 4,743,726, Hughes adds a wax core to serve as a kind of heat sink.

In U.S. Pat. Nos. 4,952,360 and 5,030,820, Gibbon constructs a microwavable hair curler from a composition including a polyorganosiloxane gum, a particulate electromagnetic absorptive material, a filler, and a catalyst. The preferred absorptive material is zinc oxide; the composition is extruded and cured ('820 col. 2, lines 1–9). A cylindrical curler is filled with a "silicon gel" by Summerville et al in U.S. Pat. No. 5,297,567 for "heat retentive purposes" (col. 3, lines 23–24).

In U.S. Pat. No. 5,456,701, Stout describes a gel contained in a sheath for use in a therapy member—that is, a heat pad. The gel comprises water, a humectant, and a crosslinked water soluble polymer. The humectant is preferably glycerin and the crosslinked water soluble polymer is preferably a crosslinked polyacrylamide. Such a gel is found to retain heat imparted by a microwave oven.

SUMMARY OF THE INVENTION

My invention includes the use of a particular class of gels on a hair curler for absorbing heat and applying it to the hair in the desired shape or form. The curler may be used in the more or less conventional shapes and forms, i.e. cylindrical, ovoid tube, helix, or other desired form or shape. I employ a rigid support in the desired shape, and place on it a layer of gel for absorbing and releasing heat. The gel is preferably encased in a flexible sheath or bladder, but may be simply covered with a sheet of flexible polymeric material, preferably permeable to moisture. The gel is preferably placed on the side of the support member to be contacted with the hair; in the case of a cylindrical shape, for example, on the outside of a plastic cylinder. It may also be placed on the inside of the cylinder or otherwise separated from the hair by the support member.

In its simplest form, the curler is complete with the support and the covered gel layer on it. Generally the gel layer may comprise any composition including a crosslinked synthetic polymer, a humectant, and at least ten percent water. Compositions disclosed by Stout in U.S. Pat. No. 5,456,701 are preferred. U.S. Pat. No. 4,671,267 and Stout's U.S. Pat. No. 5,456,701 is incorporated herein by reference. The humectant is preferably glycerin.

The preferred cylindrical support is flared on the ends to prevent longitudinal slippage of the gel layer or container. Other forms also may have flares or lips on the edges to contain the gel.

Another preferred version of my invention includes provision for separating the heated curler from the user's head. For this, a comb-like device is equipped with fastening members for attaching to the curler support.

The user places one or more curlers in a microwave oven, heats them, and curls hair around them in the conventional manner. Where a separator is used, the user inserts it under a curler and attaches it to the curler; in the case of the conventional cylindrical or ovoid tube form, means for attaching are provided on the ends of the cylindrical or ovoid tube support.

My invention has the advantage of long-lasting, moist heat together with the convenience of the ability to heat the curler in the ubiquitous microwave oven. Moisture is emitted from the gel, which prevents the common problem of dry heat damaging hair. The moisture of the gel is reconstituted between uses by the action of the humectant in the gel.

DETAILED DESCRIPTION OF THE INVENTION

Figure 1:
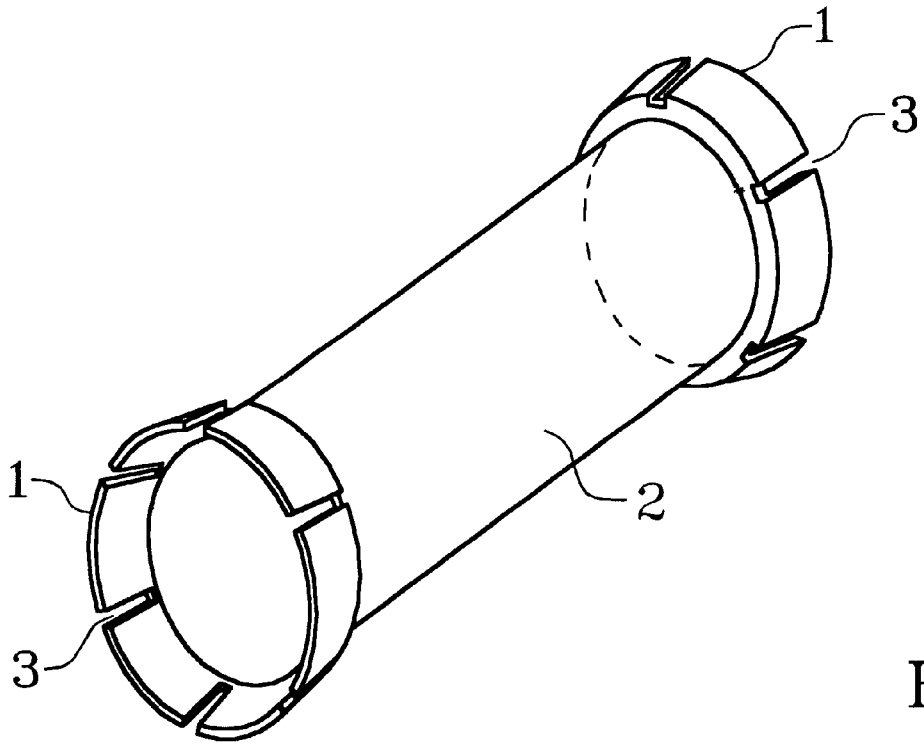
FIG. 1 is a perspective view of a preferred form of cylindrical support member for my curler.

Referring now to FIG. 1, the basic cylindrical support 2 is a relatively simple hollow cylinder preferably having flared ends 1. The cylindrical support 2 is preferably made of a thermosetting polymer, i.e. a plastic which is not melted or significantly softened by heat or damaged by microwave energy, but which is easily molded, extruded and/or fabricated. It may contain fillers, including particulate siliceous fillers or clays which may act as heat sinks. Generally the cylinder will have a diameter of from one-half inch to two inches and a length of one and one-half inches to four inches, but may be of any convenient size and shape. The flared ends I may protrude above the ends of the cylindrical surface desirably from one-eighth inch to one quarter inch. The flared ends 1 may have slots 3 adapted to attach to a separator as described elsewhere herein.

Figure 2:
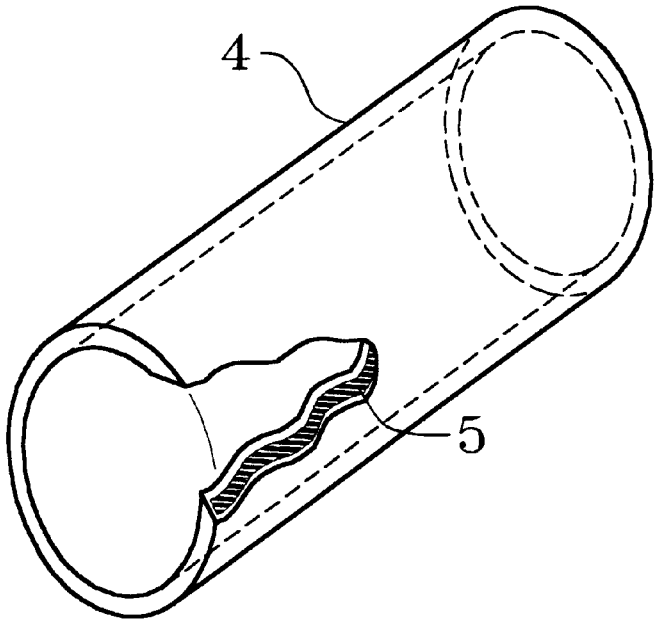
FIG. 2 is a perspective view of the gel sheath for placing around the cylindrical support of FIG. 1.

Referring to FIG. 2, the sheath 4 is also cylindrical, designed to surround cylindrical support 2 (FIG. 1) and be contained between flared ends 1 of cylindrical support 2. Sheath 4 in this configuration is a sealed container for gel 5, shown by the cut away portion of sheath 4, but it should be noted that the gel 5 may be gelled sufficiently as to hold its form even without a cover, pouch, or envelope such as sheath 4. Sheath 4 is preferably a fabric or moisture-permeable material. Preferred materials are cotton, Lycra Darlexx®, neoprene, polyester, acetate, felt, or Colorfast 2000®. For most applications, it is desirable that the material be acceptable for silk-screening, for the application of a trademark or other identifying insignia.

Gel 5 is a composition comprising water, a humectant, and a crosslinked water soluble polymer. The amount of crosslinking should be such that the gel is stable but still pliable. Compositions such as are disclosed and described by Stout in U.S. Pat. No. 5,456,701 are preferred. The preferred crosslinked water soluble polymer is a polyacrylamide preferably crosslinked with methylene bisacrylamide. The preferred composition contains a significant amount of a humectant. Glycerin is very effective as the humectant. Inorganic desiccant solutions may also be used, such as the combinations of lithium and calcium bromides and chlorides disclosed by Heath and Minger in U.S. Pat. No. 2,143,008, which is incorporated herein by reference. Also included in my composition is sufficient water for the crosslinked water soluble polymer to provide a gel consistency for the composition and, where inorganic humectants or desiccants are used, to dissolve them. Generally about 10% to about 80% water is used.

The basic ingredients of a preferred gel therefore are (a) 10–30% by weight acrylamide, preferably 18% (b) 10–80% water, preferably 18%, (c) 20–85% humectant, preferably 64% glycerin, and (d) 0.04–0.2% crosslinker, preferably 0.09% N,N methylene bisacrylamide. Crosslinking is performed in the presence of the humectant to assure that it is evenly dispersed in the gel.

Other gel compositions may be used—generally any gel which may be heated in a microwave oven and/or which contains a humectant; compositions described in U.S. Pat. No. 4,671,267 can be used.

Figure 3:
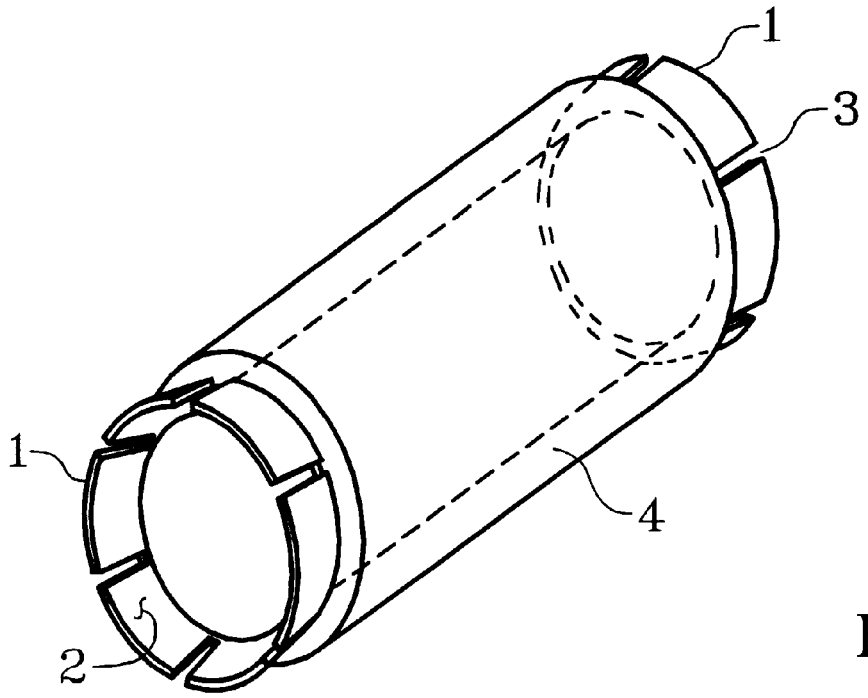
FIG. 3 shows the assembled curler, exhibiting slots for connecting a separator which will insulate the user's head from the heat of the curler.

Referring now to FIG. 3, the sheath 4 containing gel 5 (FIG. 2) has been placed on cylindrical support member 2 (FIG. 1) to achieve the assembled curler. Flared ends 1 prevent the longitudinal slippage of the sheath 4.

Figure 4:
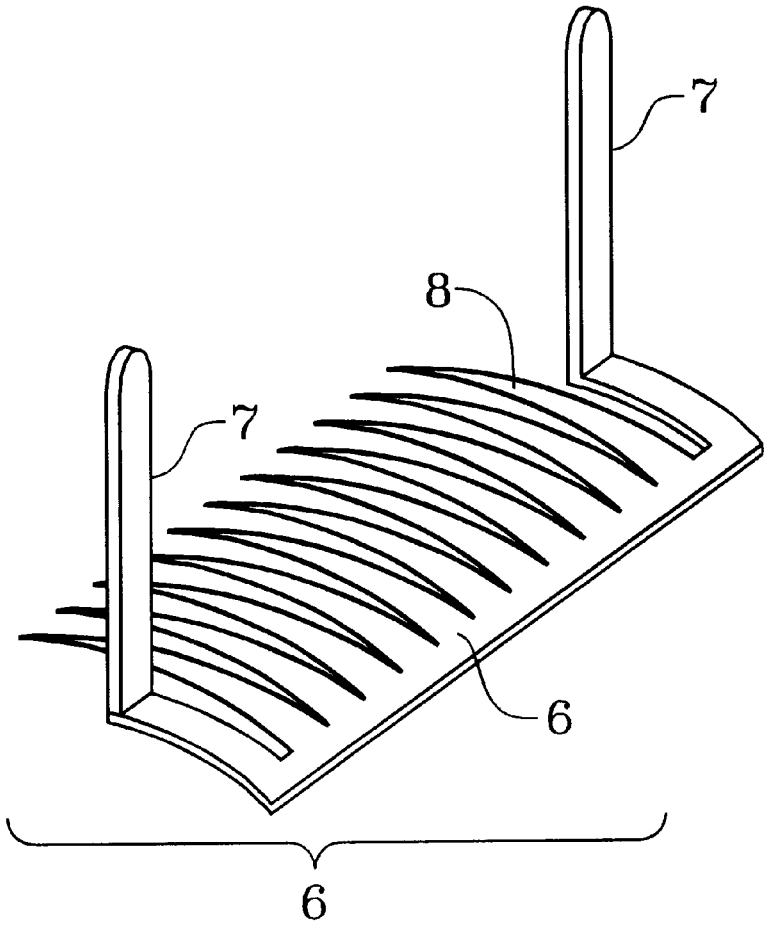
FIG. 4 is a preferred form of separator.
Figure 5:
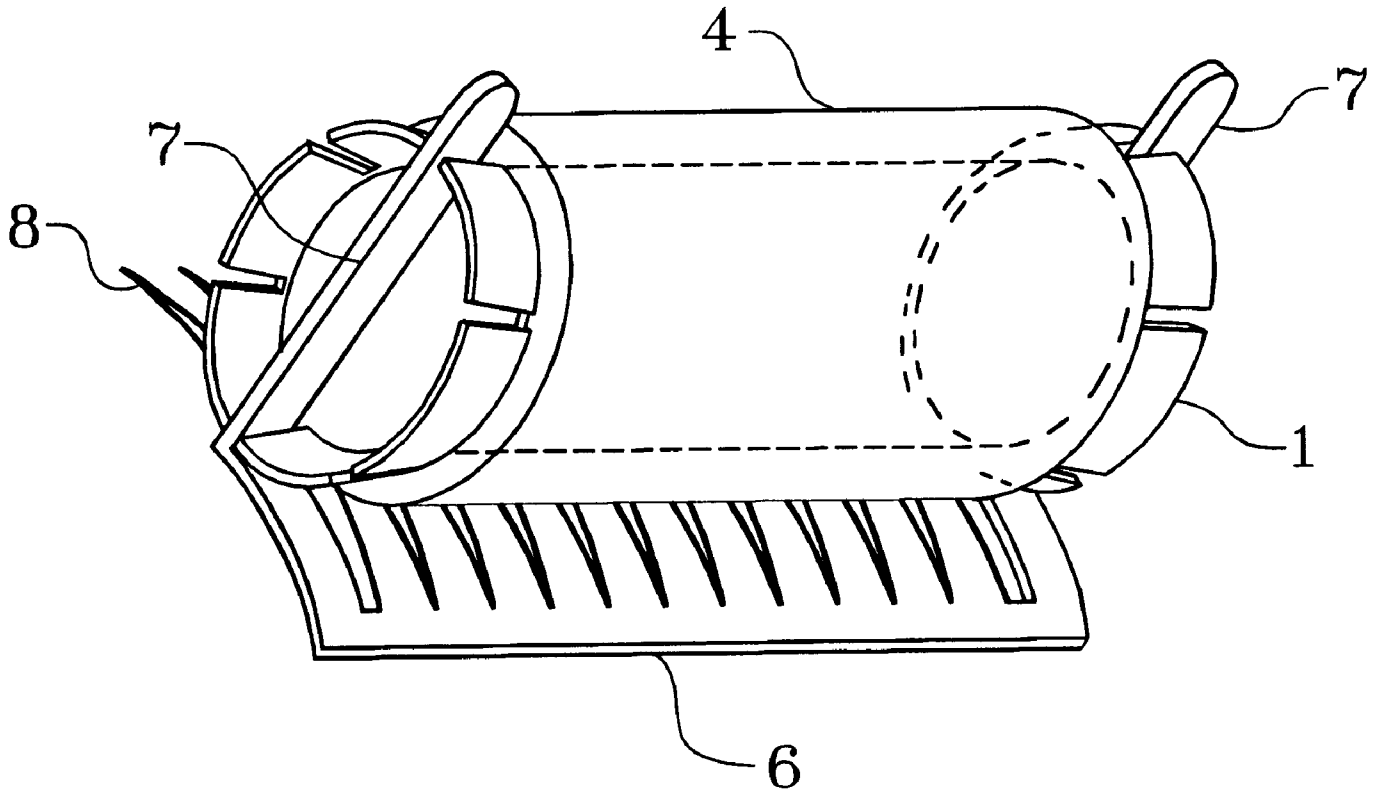
FIG. 5 shows the separator attached to the curler.

FIG. 4 illustrates a preferred version of a separator member for protecting the user's head from possibly excessive heat in the curler. Separator 6 comprises comb teeth 8 and clasp members 7 designed to fit into the notches 3 of flared ends 1 of the support member 2, as shown in FIG. 5.

Figure 6A:
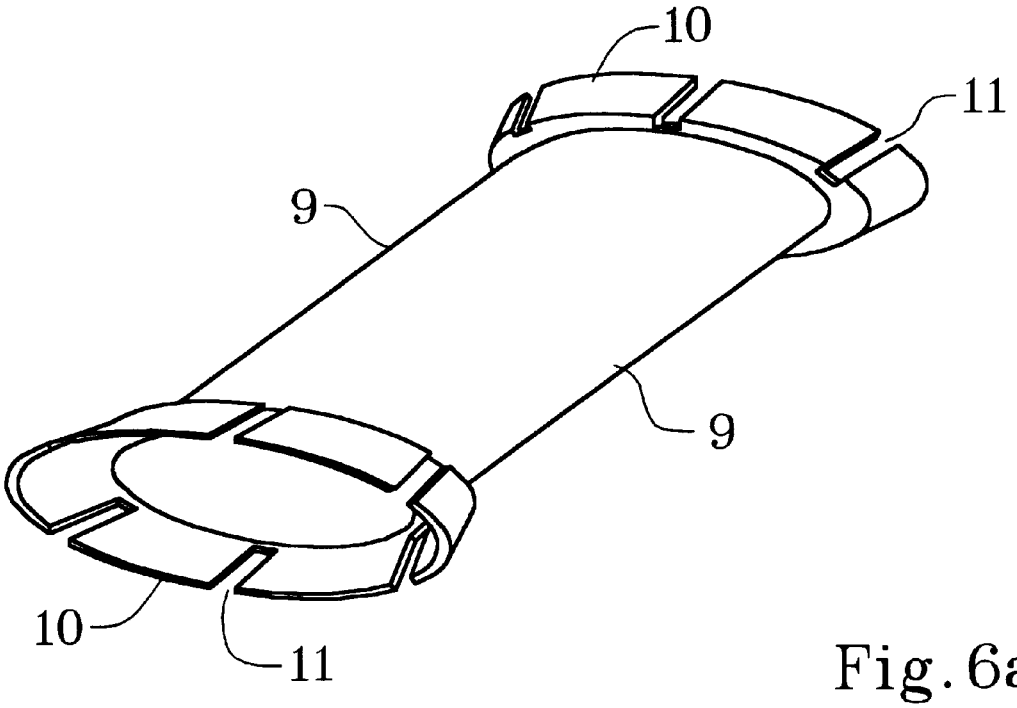
FIGS. 6*a* and 6*b* show variations of the curler for providing different curling shapes.

FIG. 6*a* shows an ovoid tube support member 9 having flared ends 10 and notches 11 similar to those of the cylindrical support of FIG. 1. A sheathed gel similar to that of FIG. 2 may be placed on this support member in a manner similar to that of FIG. 3.

Figure 6B:
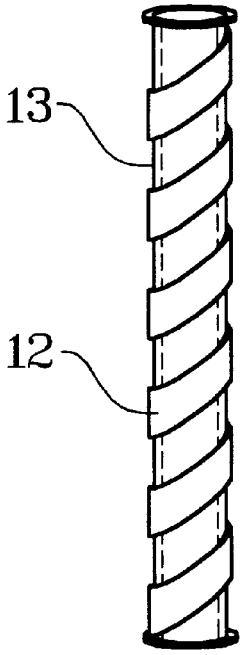

FIG. 6*b* is an alternative helical support member 12 having a helically disposed sheath 13 enclosing a gel. The gel-containing sheath in this case is a strip wound around the helical support member as shown; the hair is placed on the sheath 13 which is heated by the gel inside as in the other configurations.

What is claimed is:

1. A hair curler comprising a curler support member and a layer thereon of a gel comprising (a) a crosslinked water soluble polymer, (b) a humectant, and (c) water, said layer of gel being capable of emitting moisture when heated.

2. A hair curler of claim 1 wherein said support member is made of a thermoset plastic and is substantially in the shape of a cylinder.

3. A hair curler of claim 1 wherein said crosslinked water soluble polymer is polyacrylamide.

4. A hair curler of claim 1 wherein said humectant is glycerin.

5. A hair curler of claim 1 wherein said gel layer is covered by fabric or plastic.

6. A hair curler of claim 1 wherein said support member is substantially in the shape of a helix.

7. A hair curler of claim 1 wherein said support member is substantially in the shape of an ovoid tube.

8. A hair curler of claim 1 including a separator member for separating said curler from a user's head.

9. Hair curler apparatus comprising (a) a curler comprising a support member having a heat-absorbent gel layer thereon, said gel layer being capable of emitting moisture when heated, (b) a separator member for placing between said curler and a user's head, and (c) means for connecting said separator member and said curler.

10. Hair curler apparatus of claim 9 wherein said gel layer comprises glycerin, water, and crosslinked polyacrylamide.

11. Hair curler apparatus of claim 9 wherein said separator member comprises a comb having clasps on each end for attaching to said support member.

* * * * *